US006194109B1

(12) United States Patent
Lawton

(10) Patent No.: US 6,194,109 B1
(45) Date of Patent: Feb. 27, 2001

(54) METHODS OF DETECTING AND CORRECTING COLOR PLANE MIS-REGISTRATION ON AN INTERMEDIATE TRANSFER BELT

(75) Inventor: Robert J. Lawton, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/395,263

(22) Filed: Sep. 14, 1999

(51) Int. Cl.[7] ..... G03E 13/16

(52) U.S. Cl. ..... 430/47; 430/43; 430/44; 430/30; 399/49; 399/66

(58) Field of Search ..... 430/43, 44, 47, 430/30; 399/66, 49, 301

(56) References Cited

U.S. PATENT DOCUMENTS 4,341,461 * 7/1982 Fantozzi ..... 399/49
5,204,729 * 4/1993 Maeda et al. ..... 399/231
5,765,087 * 6/1998 Yano et al. ..... 399/344
5,809,365 * 9/1998 Yoshizawa ..... 399/49
6,038,423 * 3/2000 Tagawa et al. ..... 399/301

* cited by examiner

*Primary Examiner*—Christopher D. RoDee

(57) ABSTRACT

In one aspect, the invention encompasses a method of using an image forming device. A first pattern of toner is provided on a photosensitive drum of the image forming device. The toner is transferred from the photosensitive drum to an intermediate transfer belt to form a second pattern. After forming the second pattern, a bias of the photosensitive drum is reversed relative to the intermediate transfer belt and toner is transferred back to the photosensitive drum from the intermediate transfer belt to form a third pattern of toner on the photosensitive drum. In another aspect, the invention encompasses a method of detecting inaccuracies in toner placement on an intermediate transfer belt of an image forming device. A first pattern of black, magenta, cyan and yellow toners is provided on a photosensitive drum of the image forming device. The toners are transferred from the photosensitive drum to an intermediate transfer belt of the image forming device to form a second pattern. Subsequently, and without transferring the toner from the intermediate transfer belt to a substrate processed by the image forming device, measuring at least one property of the second pattern to determine if the second pattern is an accurate reproduction of the first pattern.

17 Claims, 8 Drawing Sheets

METHODS OF DETECTING AND CORRECTING COLOR PLANE MIS-REGISTRATION ON AN INTERMEDIATE TRANSFER BELT

FIELD OF THE INVENTION

The invention pertains to methodology associated with toner transfer in electrophotographic image forming devices, such as laser printers and copiers. In particular aspects, the invention pertains to methods of detecting and correcting inaccuracies in toner transfer from a photosensitive drum to an intermediate transfer belt.

BACKGROUND OF THE INVENTION

In electrophotographic image transfer, a pattern of electrostatic charges corresponding to an image is developed on an optical photoreceptor (OPR), such as a photosensitive drum. Toner is applied to the OPR, and that toner which is retained as a result of not being repelled by electrostatic charges forms a pattern which is transferred to an intermediate transfer belt, and then to a substrate (such as, for example, paper or plastic media). In color image forming devices, there typically will be four colors of toner (black, magenta, cyan and yellow) applied to the photosensitive drum and subsequently transferred from the drum to the intermediate transfer belt (although in some systems only three colors are used, and in other systems more than four colors can be used, with an exemplary seven-color system using black, magenta, yellow, cyan, red, green, and blue). The colors are generally transferred in the order of black, magenta, cyan, and finally yellow, with the transfer of any color not occurring until the transfer of all colors preceding that color in the listed order are finished. Accordingly, the formation of a pattern on the photosensitive drum, and subsequent transfer of the pattern to the intermediate transfer belt, occurs four times (once for each of the colors black, magenta, cyan and yellow), with the overlapping patterns on the intermediate transfer belt forming an image that is to be transferred to the substrate. It is noted that single-color patterns are typically transferred from the OPR to the intermediate transfer belt before an entirety of the single-color of toner that is ultimately to be formed on the intermediate transfer belt has been transferred to the OPR. For instance, black toner will typically begin to transfer from the OPR to the intermediate transfer belt while additional black toner is still being applied to the OPR. The toner is not, however, typically transferred from the intermediate transfer belt to the substrate until an entire image (i.e., an image containing all four of the colors of magenta, cyan, yellow and black) is formed on the intermediate transfer belt. The image formed on the intermediate transfer belt can correspond to, for example, an entirety of an image formed on a single sheet of paper. The intermediate transfer belt can be, for example, long enough to contain a complete legal document image wrapped around its circumference, plus a few extra inches. The extra space on the intermediate transfer belt between the top and bottom of the image formed on the intermediate transfer belt is called the inter-document zone.

Specific steps utilized in forming an image with a prior art image transfer device are described with reference to FIGS. 1–3. Referring to FIG. 1, a prior art image forming device 10 comprises a rotating photosensitive drum 12 (with the rotation indicated by an arrow 23) and an intermediate transfer belt 14 moving past drum 1 2 in a direction indicated by arrow 25. Photosensitive drum 1 2 carries a pattern of positive charges 1 6 on its surface, and such positive charges retain negatively charged toner particles 1 8.

A support structure 20 and a primary transfer roller 22 are provided to support intermediate transfer belt 14. Primary transfer roller 22 is in electrical connection with a DC power source 24, and is utilized to provide a positive charge to intermediate transfer belt 14. Such positive charge attracts the negatively charged toner from photosensitive drum 12 onto intermediate transfer belt 14. The FIG. 1 process of transferring toner from photosensitive drum 12 to intermediate transfer belt 14 is repeated four times in a color image transfer process (one time each for the black, magenta, cyan and yellow toners). The positive bias applied to transfer roller 22 is generally increased after each toner pass to compensate for increasing layers of toner.

FIG. 2 illustrates intermediate transfer belt 14 after an entire image has been formed on intermediate transfer belt 14. Specifically, four layers of toner 18 (only some of toner 18 is labeled in FIG. 2) are shown applied over transfer belt 14, with the layers corresponding to black, magenta, cyan and yellow toners. In the view of FIG. 2, transfer belt 14 is moved in a direction indicated by arrow 30.

FIG. 2 further shows a substrate 34 being fed through feed support structures 33 of apparatus 10 and across a secondary transfer roller 36, in a direction indicated by arrow 31. Secondary transfer roller 36 is in electrical connection with a DC power source 38. Power source 38 creates a positive charge which pulls toner 18 from intermediate transfer belt 14 onto substrate 34. After the toner is transferred to substrate 34, the toner is fused to substrate 34. Subsequently, substrate 34 exits device 10.

A difficulty in the processing of FIGS. 1 and 2 can be in maintaining consistent toner density during repeated printing operations. For instance, it is found that toner density can vary due to environmental conditions, deteriorated toner, or a deteriorated photosensitive drum. A method of monitoring and maintaining toner density is described with reference to FIG. 3.

FIG. 3 illustrates the photosensitive drum 12 of apparatus 10, and further shows a pattern of toner patches 40 (only some of the toner patches 40 are labeled) which has been provided over a surface of photosensitive drum 12. Toner patches 40 preferably vary in density relative to one another, with the densities being determined by a controller 42. Controller 42 is in data communication with a density sensor 45 which comprises a light emitting diode (LED) 44, and a pair of photodiodes 46 and 48. Density sensor 45 is utilized to read densities of toner patches 40. Specifically light is emitted from LED 44 and received directly by photodiode 48, as well as reflected from toner patches 40 to be received by photodiode 46. The signals received by photodiodes 46 and 48 are compared utilizing processing circuitry within controller 42. Controller 42 can then adjust parameters associated with toner transfer to correct for errors encountered in the densities of toner patches 40.

In spite of the above-described methodologies for correcting errors in toner density, inaccuracies in toner application (such as, for example, errors in spatial alignment) can still be found in images formed by image transfer devices of the type described with reference to FIGS. 1–3. A method of detecting such errors is to print test patterns on substrate passed through apparatus 10.

However, while such test patterns can be useful for identifying errors, it is generally time-consuming to run and utilize such test patterns. Further, it is generally desirable to utilize methodologies which can be incorporated into image forming apparatuses to automatically detect and correct toner transfer errors without human intervention. The printing of test patterns on substrates passed through an image forming device is generally difficult to incorporate into such automatic detection and correction mechanisms. Accordingly, it would be desirable to develop alternative methodologies for detecting toner transfer inaccuracies and to incorporate such methodologies into processes which can automatically detect inaccuracies in toner transfer and correct such inaccuracies.

SUMMARY OF THE INVENTION

In one aspect, the invention encompasses a method of using an image forming device. A first pattern of toner is provided on a photosensitive drum of the image forming device. The toner is transferred from the photosensitive drum to an intermediate transfer belt to form a second pattern. After forming the second pattern, a bias of the photosensitive drum is reversed relative to the intermediate transfer belt and toner is transferred back to the photosensitive drum from the intermediate transfer belt to form a third pattern of toner on the photosensitive drum.

In another aspect, the invention encompasses a method of detecting inaccuracies in toner placement on an intermediate transfer belt of an image forming device. A first pattern of black, magenta, cyan and yellow toners is provided on a photosensitive drum of the image forming device. The toners are transferred from the photosensitive drum to an intermediate transfer belt of the image forming device to form a second pattern. Subsequently, and without transferring the toner from the intermediate transfer belt to a substrate processed by the image forming device, measuring at least one property of the second pattern to determine if the second pattern is an accurate reproduction of the first pattern.

DESCRIPTION OF THE DRAWINGS

FIG. 5 is a diagrammatic top view of an intermediate transfer belt which has been processed in accordance with the present invention. (The intermediate transfer belt of FIG. 5 is shown in a form of being cut and laid out flat for illustration purposes, even though the actual form would be a closed loop.) FIG. 5 shows a first embodiment pattern of transferred toner on the intermediate transfer belt in an inter-document zone.

FIG. 7 is a view of the FIG. 4 apparatus fragment shown at a processing step subsequent to that of FIG. 4 in accordance with a method of the present invention.

DETAILED DESCRIPTION OF THE INVENTION

Figure 1:
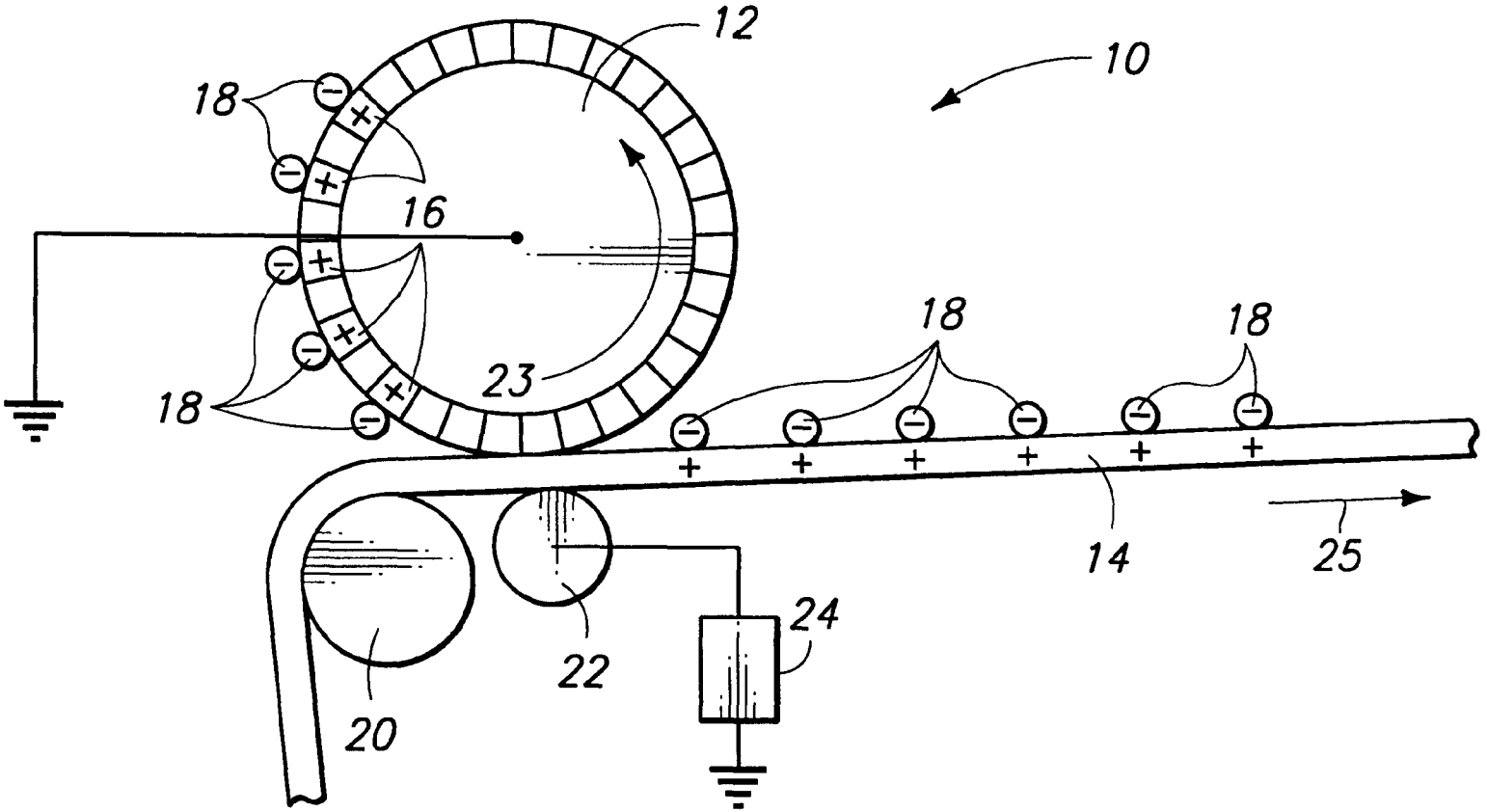
FIG 1 PRIOR ART
FIG. 1 is a diagrammatic, fragmentary, cross-sectional side view of a portion of a prior art image forming device.
Figure 2:
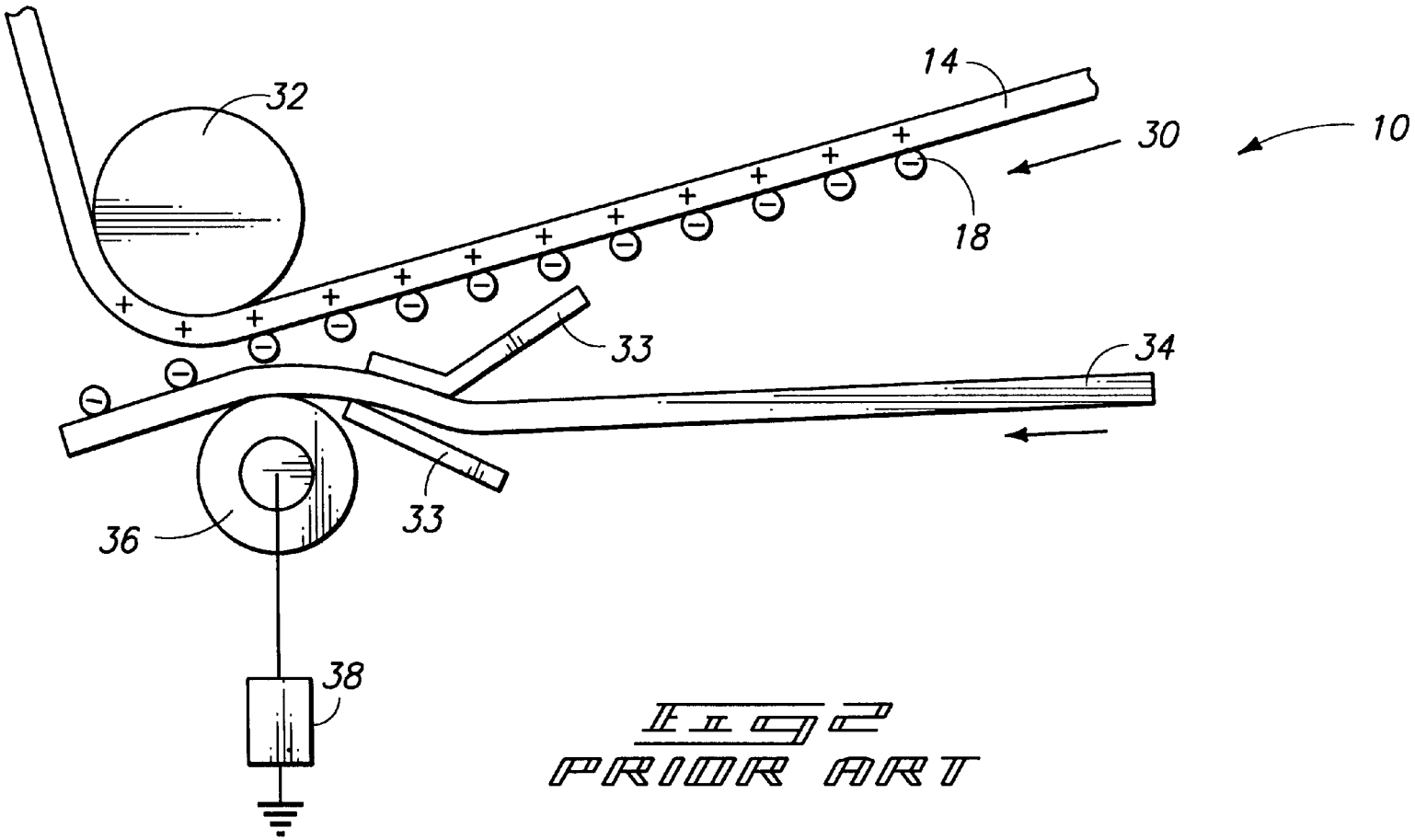
FIG 2 PRIOR ART
FIG. 2 is a diagrammatic, cross-sectional, fragmentary, side view of another portion of the prior art device of FIG. 1.
Figure 3:
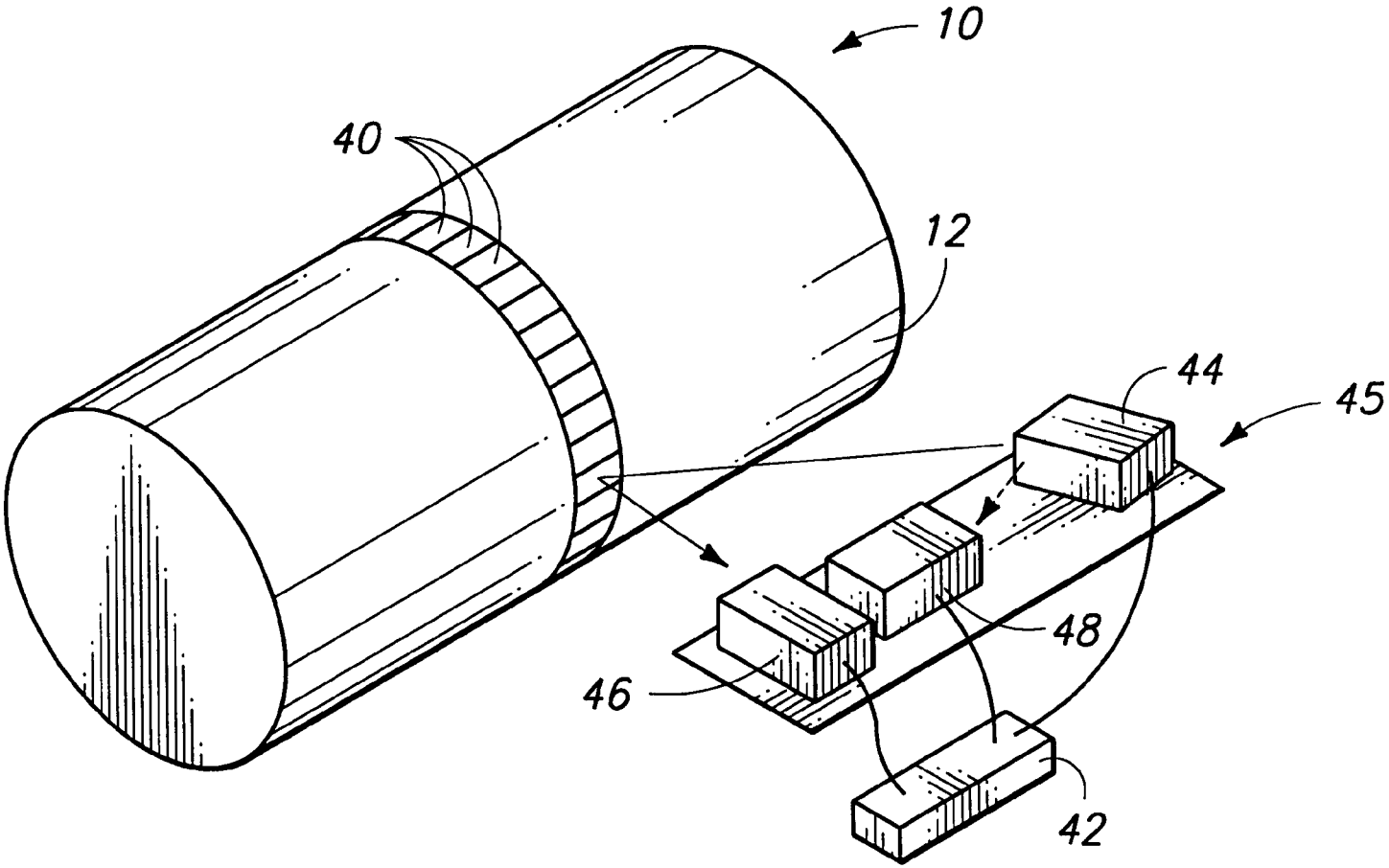
FIG 3 PRIOR ART
FIG. 3 is a diagrammatic, perspective view of yet another portion of the apparatus of FIG. 1.

The invention encompasses new methodologies for utilizing image forming devices, and, in particular embodiments, pertains to new methodologies which can be utilized for detecting and correcting inaccuracies of toner transfer. An exemplary process of the present invention is described with reference to FIGS. 4–8. In referring to FIGS. 4–8, similar numbering to that utilized above in describing FIGS. 1–3 will be used, with the suffix "a" utilized to indicate structures shown in FIGS. 4–8.

Figure 4:
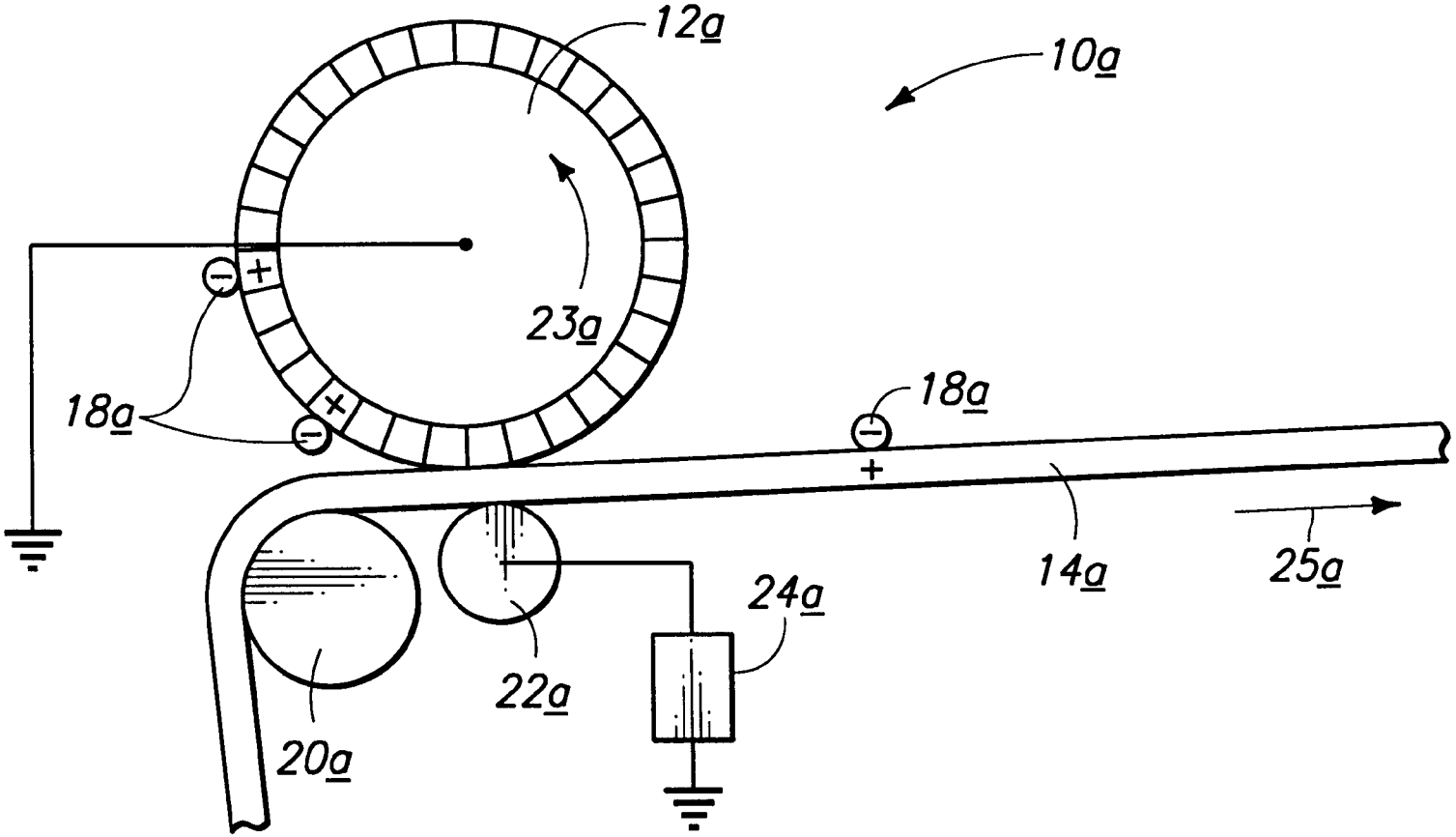
FIG. 4 is a diagrammatic, fragmentary, cross-sectional side view of an image forming apparatus incorporated into a method of the present invention.
Figure 11:
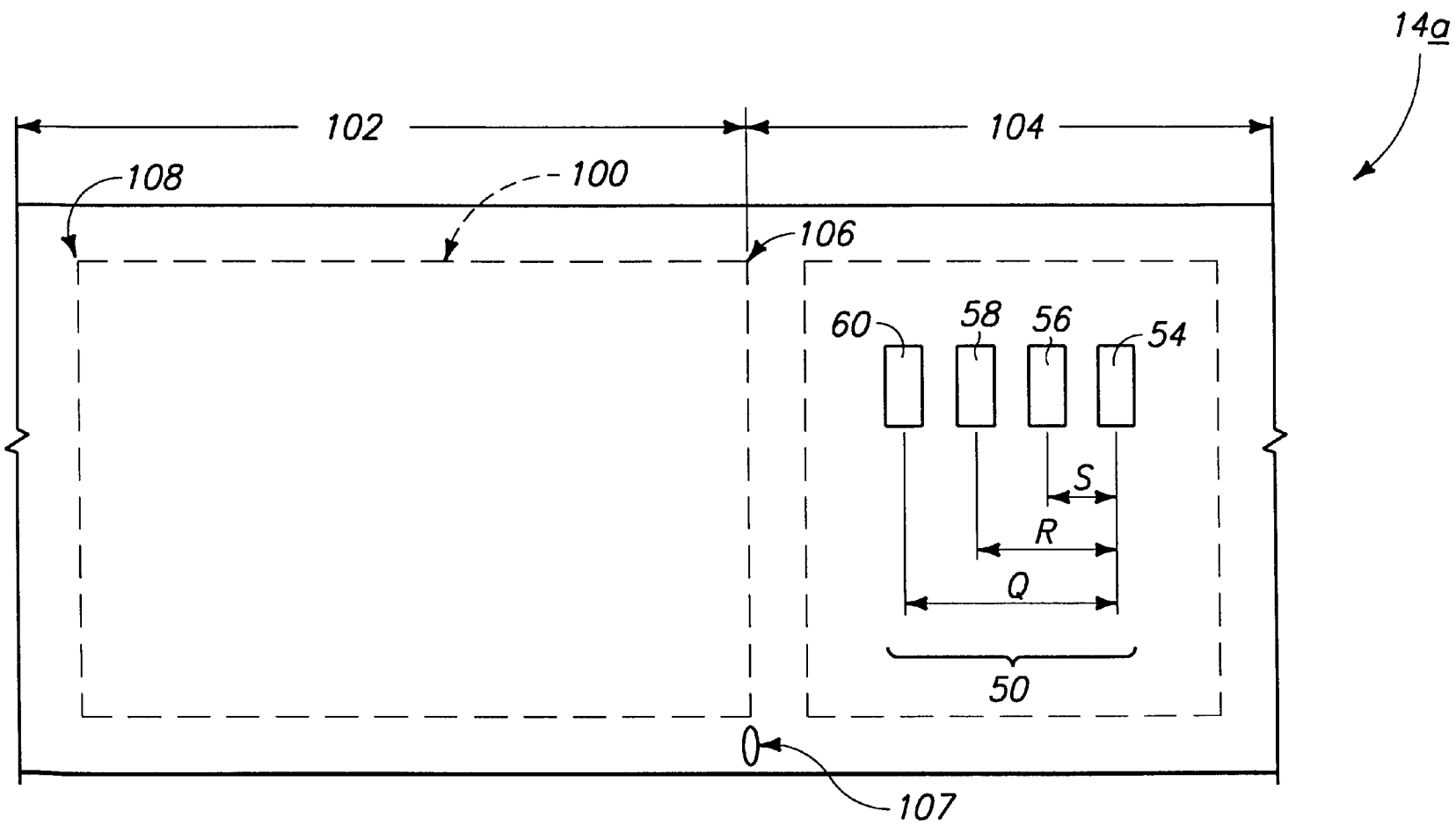

Referring to FIG. 4, an image forming apparatus 10*a* comprises identical components to those described above with reference to apparatus 10 of FIG. 1, including a photosensitive drum 12*a* and an intermediate transfer belt 14*a*. In accordance with the present invention, toner 18*a* is formed on photosensitive drum in a first pattern and transferred to image transfer belt 14*a* to form a second pattern. In the shown processing step, the toner 18*a* is preferably provided on intermediate transfer belt 14*a* to form a series of lines of a single color toner on transfer belt 14*a*. In subsequent processing steps, other colors of toner are applied to photosensitive drum and transferred to intermediate transfer belt 14*a* to transfer additional lines onto intermediate transfer belt 14*a* which comprise other colors of toner. In a preferred embodiment of the invention, the pattern ultimately formed on intermediate transfer belt 14*a* comprises three sets of four spaced lines, with each of the four lines corresponding to a different toner color (typically either black, magenta, cyan or yellow).

Figure 6:
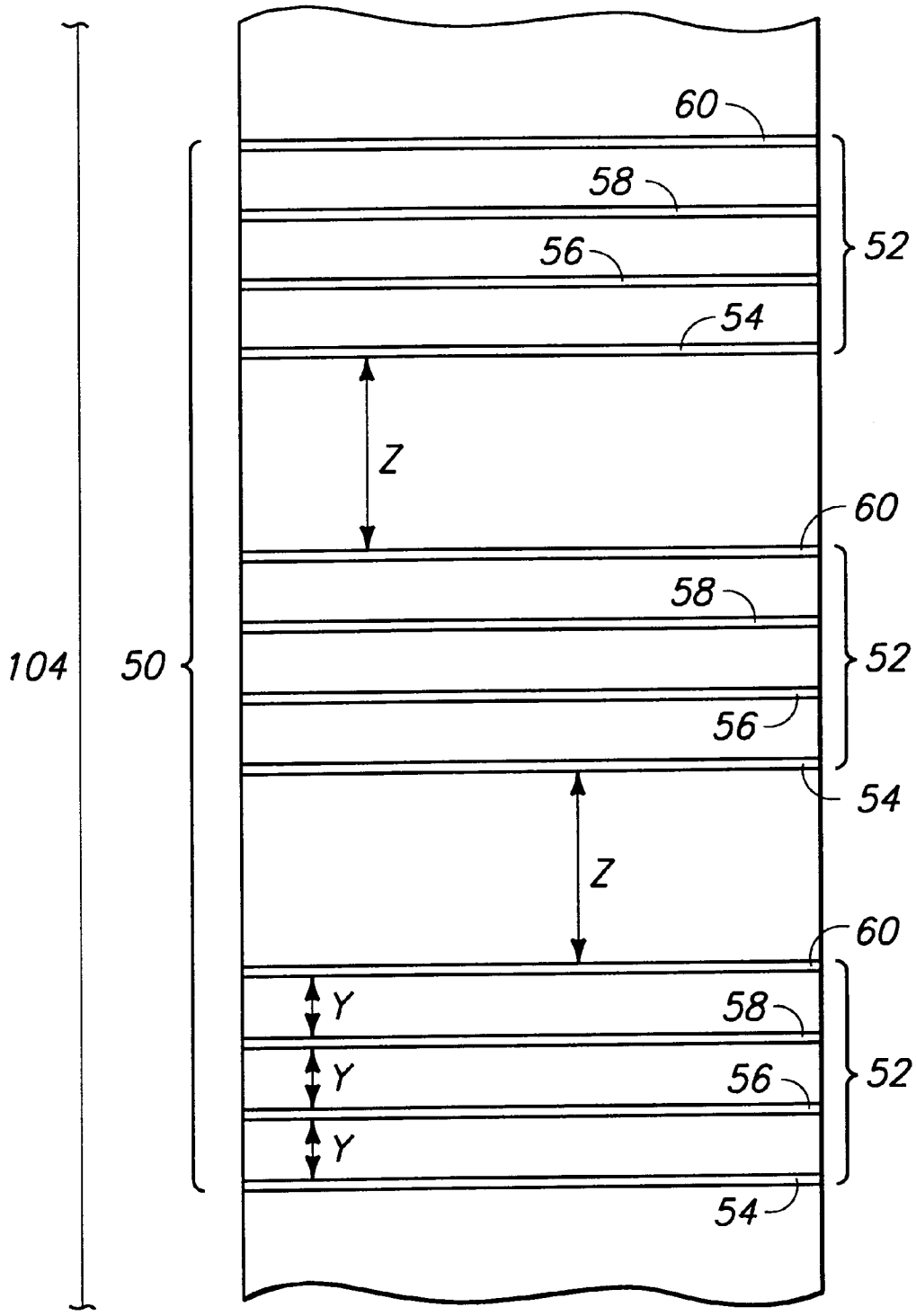
FIG. 6 is a diagrammatic, fragmentary top view of an inter-document zone of an intermediate transfer belt showing a second embodiment pattern of transferred toner.
Figure 11:
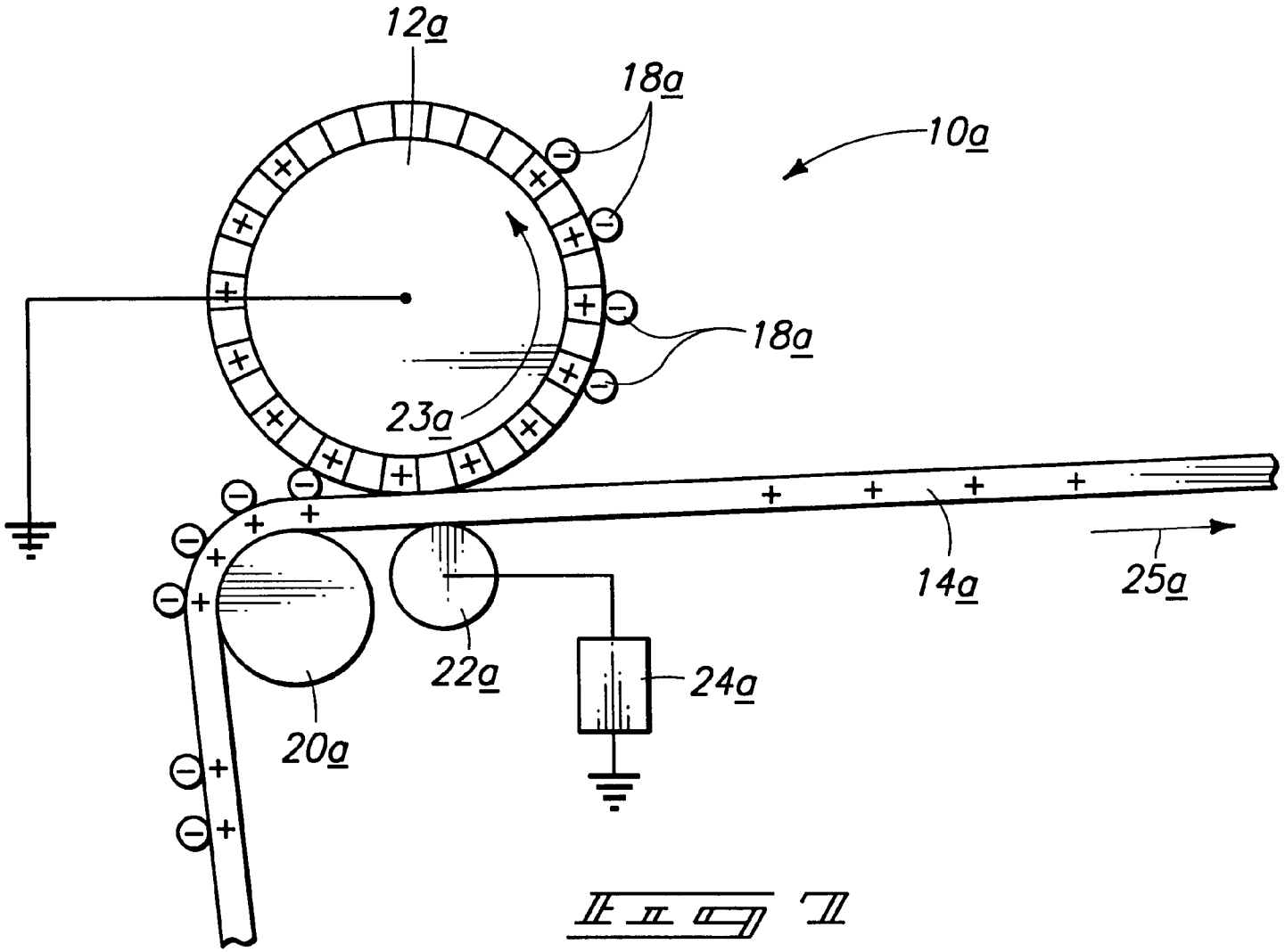

Exemplary patterns of toner on belt 14*a* are illustrated in FIGS. 5 and 6. FIG. 5 is a top view of intermediate transfer belt 14*a*. The belt 14*a* of FIG. 5 is shown in a form of being cut and laid flat. Such form is utilized to aid in illustrating a pattern that has been formed on belt 14*a*, and is not the actual form of belt 14*a* within apparatus 10*a*. Rather, belt 14*a* in apparatus 10*a* would be in the form of a closed loop.

FIG. 5 shows that belt 14*a* comprises a document zone 102 and an inter-document zone 104. A document image 100 has been formed in document zone 102, with document 100 having a top edge 106 and a bottom edge 108. Toner has been provided in the inter-document zone 104 to form a second pattern 50 comprising four spaced lines 54, 56, 58 and 60. Each of lines 54, 56, 58 and 60 corresponds to a different color of toner. For instance, line 54 can correspond to black toner, line 56 to magenta toner, line 58 to cyan toner and line 60 to yellow toner. Lines 54 and 60 are separated by spacing Q, lines 54 and 58 are separated by spacing R, and lines 54 and 56 are separated by spacing S. In an exemplary embodiment, a photosensor (not shown) is provided to detect a top-of-form fiducial 107. Once top-of-form fiducial 107 is detected, a printer processor delays printing for seven dot rows and then begins streaming data for the first line of black image 54. Ultimately, each of lines 54, 56, 58 and 60 is formed.

FIG. 6 is an expanded view of an inter-document zone 104 showing a preferred embodiment of second pattern 50. In referring to FIG. 6, identical numbering will be used to that utilized above in describing FIG. 5. In the preferred embodiment of FIG. 6, second pattern 50 comprises three sets 52 of four spaced lines 54, 56, 58 and 60. Each of lines 54, 56, 58 and 60 corresponds to a different color of toner. For instance, line 54 can correspond to black toner, line 56 to magenta toner, line 58 to cyan toner and line 60 to yellow toner. Lines 54, 56, 58 and 60 are spaced from one another by a distance "y" which is preferably from about 0.25 mm to about 3 mm, and more preferably about 1 mm.

Referring to FIG. 7, a bias of the charge of photosensitive drum 12*a* relative to intermediate transfer belt 14*a* is reversed such that toner 18*a* is transferred back to photosensitive drum 12*a*. Such lifts the second pattern 50 (FIG. 6) from intermediate transfer belt 14*a* and deposits the toner of lines 54, 56, 58 and 60 (FIG. 6) onto photosensitive drum 12*a* as a third pattern. In a preferred embodiment, such third pattern will comprise three sets of four lines corresponding to the three sets of four lines of second pattern 50.

Figure 8:
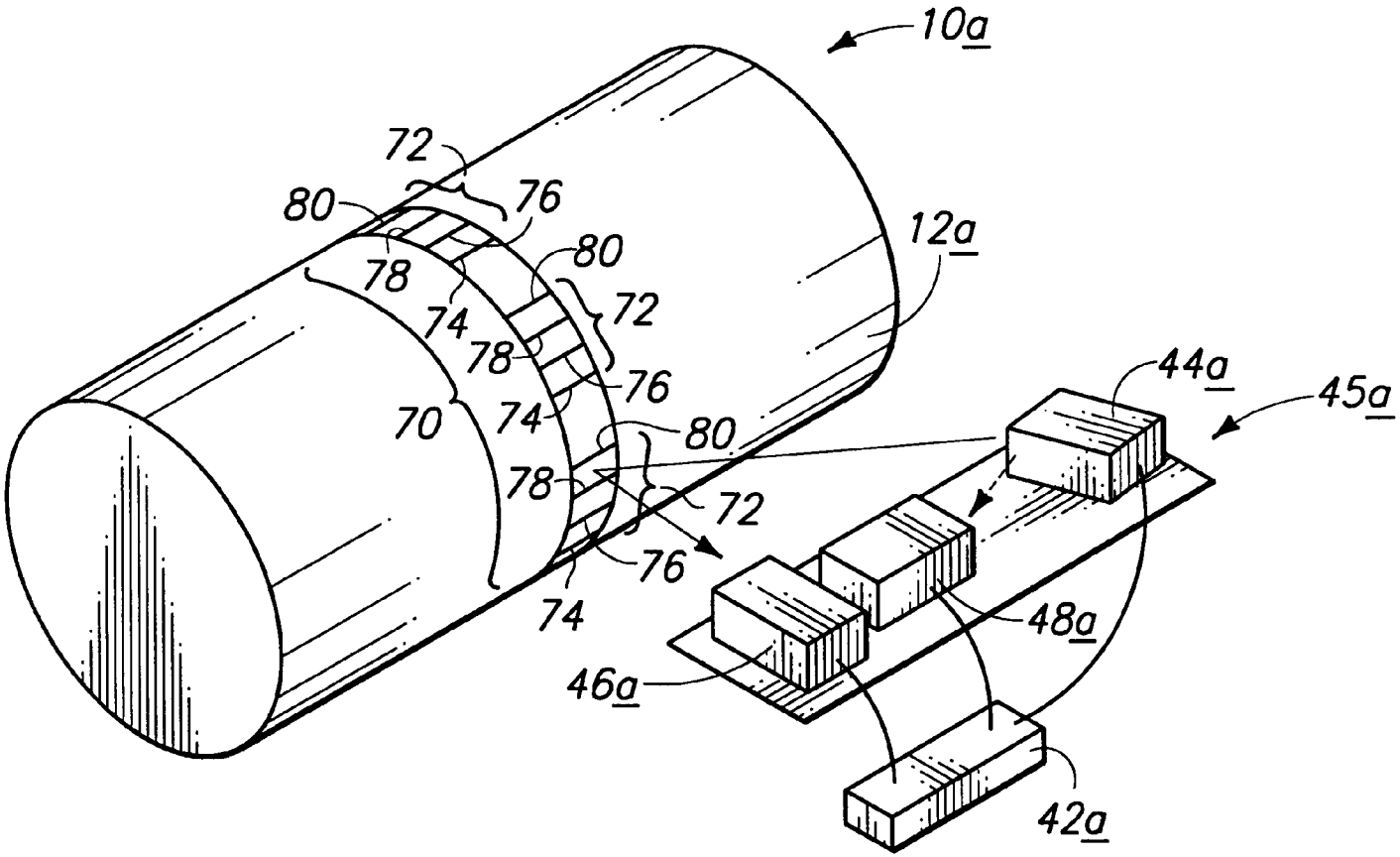
FIG. 8 is a diagrammatic, perspective view of a portion of an image forming apparatus incorporated into a method of the present invention.

Referring to FIG. 8, photosensitive drum 12*a* is shown in a view which illustrates the third pattern (labeled as 70). Pattern 70 comprises three sets 72 of four lines 74, 76, 78 and 80. Lines 74, 76, 78 and 80 correspond to lines 54, 56, 58 and 60 of second pattern 50 (FIG. 6), and accordingly preferably comprise single colors of toner, with the lines corresponding to black, magenta, cyan and yellow toner colors.

In accordance with the present invention, a property of one or more of the lines of pattern 70 is analyzed to determine if such property falls within an expected range. If such property is found to fall outside of the expected range, it is determined that there is an error in toner transfer between photosensitive drum 12*a* and intermediate transfer belt 14*a*. Accordingly, a parameter which influences toner transfer between photosensitive drum 12*a* and intermediate transfer belt 14*a* is changed to reduce the error. Such parameter can be, for example, a parameter that influences the time between detection of top edge 106 and generation of an image enable signal that initiates printing of one or more of lines 54, 56, 58 and 60.

In the exemplary shown embodiment, a density sensing unit 45*a* is utilized to measure properties of one or more of lines 74, 76, 78 and 80. Such measured properties can correspond to time between lines from which spacings between the lines are calculated. (Typically, the time will be measured as a center-to-center time between the lines, rather than an edge-to-edge time.) Density sensor 45*a* is controlled by a controller 42*a*, and information obtained from density sensor 45*a* is passed to controller 42*a*. Controller 42*a* can then compare measured values with expected values that have been previously provided to controller 42*a* (such provision can comprise, for example, hard wiring the values into controller 42*a* or sending the values to controller 42*a* with software). If the measured values are found to be outside of an expected range, controller 42*a* can adjust a parameter that influences toner transfer between photosensitive drum 12*a* and intermediate transfer belt 14*a* (exemplary parameters that influence toner transfer are a speed of movement of intermediate transfer belt 14*a*, a speed of rotation of photosensitive drum 12, and a location of toner placement on photosensitive drum 12).

In an exemplary application, density sensor 45*a* can be utilized to measure a relative spacing of the yellow toner lines from one or more of the other lines of pattern 70. It is found that there are commonly errors in placement of yellow lines on an intermediate transfer belt from a photosensitive drum. A reason for the errors can be that the combined masses of other toner colors provided on the intermediate transfer belt before yellow causes deflection the intermediate transfer belt by the time yellow is deposited. The amount of deflection may be only one or two microns, however such deflection is enough to cause yellow to be slightly offset from its desired orientation. The human eye can be extremely sensitive to subtle variations in color, and can detect the slight misalignment of yellow. Accordingly, it is desirable to cure the misalignment of yellow. The methodology of the present invention can be utilized to automatically detect if yellow is being misaligned, and to change operating parameters of image forming apparatus 10 to correct such misalignment. Of course, the present invention can be utilized for detecting misalignment of other colors besides yellow, such as, for example, cyan or magenta.

The present invention advantageously utilizes a sensor (45*a* of FIG. 8) that is already present in many color printing apparatuses to measure properties of toner provided on an intermediate transfer belt. It is noted, however, that the invention encompasses other embodiments (not shown) wherein a sensor is built into an image forming apparatus specifically to be utilized with methodology of the present invention. In such applications, the sensor can be provided at any convenient location of the apparatus, and can, for example, be provided to directly measure properties of toners deposited on an intermediate transfer belt, rather than measuring such properties through an indirect measurement occurring after the toner is transferred to a photosensitive drum.

In a particular aspect of the present invention, color plane mis-registration is determined by comparing predicted distance between toner lines to measured distances. For instance, the distances "Q", "R" and "S" described above with reference to FIG. 5 would have predicted values based on the intermediate transfer belt velocity and time measured between centers of the lines. Actual values could be measured from the drum 12*a*. For instance, to measure the value of "S" a clock can be started when sensor 45*a* detects the leading edge of bar 54 (black) and stopped when sensor 45*a* detects the leading edge of bar 56 (magenta). If measured values of "Q", "R" or "S" are different than the predicted values, color plane mis-registration has occurred. Such mis-registration can be corrected by modifying a value utilized by a printer processor (or controller) to advance or retard the magenta, cyan or yellow planes in relation to the black plane (such as, for example, modifying a delay from when a top-of-form fiducial is detected until data is streamed). Such modification of a value can correct the mis-registration for pages printed subsequent to that for which the mis-registration was detected. Methodology of the present invention can accordingly be utilized to calibrate a printer for mis-registration. Preferably, toner would be printed in the inter-document zone in accordance with the present invention on only a small percentage of the documents produced by a printer to reduce toner waste. For instance, toner could be printed on every 25th page printed by a printer.

What is claimed is:

1. A method of using an image forming device, comprising:

providing a first pattern of toner on a photosensitive drum of the image forming device;

transferring the toner from the photosensitive drum to an intermediate transfer belt of the image forming device to form at least part of a second pattern;

after forming the second pattern, reversing a bias of the photosensitive drum relative to the intermediate transfer belt; and transferring toner back to the photosensitive drum from the intermediate transfer belt to form a third pattern of toner on the photosensitive drum.

2. The method of claim 1 wherein the first pattern comprises a plurality of spaced lines.

3. The method of claim 1 wherein the third pattern comprises a plurality of spaced lines, and further comprising measuring a spacing between the lines.

4. The method of claim 3 wherein the spaced lines comprise three or more differently colored lines.

5. The method of claim 3 wherein the spaced lines comprise three sets of three or more differently colored lines.

6. The method of claim 5 wherein the three or more differently colored lines are four differently colored lines corresponding to black, magenta, cyan and yellow lines.

7. The method of claim 1 wherein the third pattern comprises a plurality of spaced lines, the spaced lines comprising a black line, a cyan line, a magenta line and a yellow line, and further comprising measuring a spacing between the yellow line and an other of the spaced lines to determine if the yellow line of the third pattern is shifted relative to a position which would be expected if there were no inaccuracies in the transfer of yellow toner to and from the intermediate transfer belt.

8. The method of claim 7 further comprising, if the yellow line of the third pattern is determined to be shifted, passing information about the shift to a controller which changes a parameter that influences toner transfer from the photosensitive drum to the intermediate transfer belt to reduce the shifting of the yellow line relative to the expected position.

9. A method of detecting inaccuracies in toner placement on an intermediate transfer belt, comprising:

providing a first pattern of toner on a photosensitive drum;

transferring the toner from the photosensitive drum to an intermediate transfer belt to form at least part of a second pattern;

after forming the second pattern, reversing a bias of the photosensitive drum relative to the intermediate transfer belt;

transferring toner back to the photosensitive drum from the intermediate transfer belt to form a third pattern of toner on the photosensitive drum; and measuring at least one property of the third pattern while the third pattern is on the photosensitive drum.

10. The method of claim 9 wherein the third pattern comprises a plurality of spaced lines, the lines comprising at least two different colors of toner.

11. A method of detecting inaccuracies in toner placement on an intermediate transfer belt, comprising:

providing a first pattern of toner on a photosensitive drum;

transferring the toner from the photosensitive drum to an intermediate transfer belt to form at least part of a second pattern;

transferring toner back to the photosensitive drum from the intermediate transfer belt to form a third pattern of toner on the photosensitive drum, the third pattern including a plurality of spaced lines; and measuring at least one property of the third pattern while the third pattern is on the photosensitive drum, wherein the at least one measured property comprises a spacing between the spaced lines.

12. The method of claim 11 wherein the spaced lines comprise four differently colored lines.

13. The method of claim 12 wherein the four differently colored lines comprise black, magenta, cyan and yellow.

14. The method of claim 9 further comprising:

determining if the measured property is within a desired range; and if the measured property is not within the desired range, determining that there is an error in toner transfer between the photosensitive drum and the intermediate transfer belt, and changing a parameter that influences toner transfer between the photosensitive drum and the intermediate transfer belt to reduce the error.

15. A method of detecting inaccuracies in toner placement on an intermediate transfer belt of an image forming device, comprising:

providing a pattern of black toner on a photosensitive drum of an image forming device;

transferring the black toner from the photosensitive drum to an intermediate transfer belt of the image forming device to form a first part of a second pattern;

providing a pattern of magenta toner on the photosensitive drum;

transferring the magenta toner from the photosensitive drum to the intermediate transfer belt to form a second part of the second pattern;

providing a pattern of cyan toner on the photosensitive drum;

transferring the cyan toner from the photosensitive drum to the intermediate transfer belt to form a third Dart of the second pattern;

providing a pattern of yellow toner on the photosensitive drum;

transferring the yellow toner from the photosensitive drum to the intermediate transfer belt to form a fourth part of the second pattern;

after forming the four parts of the second pattern and without transferring the toner from the intermediate transfer belt to a substrate processed by the image forming device, transferring the toner from the intermediate transfer belt back to the photosensitive drum; and after the toner is transferred back to the photosensitive drum, measuring at least one property of the second pattern to determine if the property is within a desired range.

16. A method of detecting inaccuracies in toner placement on an intermediate transfer belt of an image forming device, comprising:

providing a pattern of black toner on a photosensitive drum of an image forming device;

transferring the black toner from the photosensitive drum to an intermediate transfer belt of the image forming device to form a first part of a second pattern;

providing a pattern of magenta toner on the photosensitive drum;

transferring the magenta toner from the photosensitive drum to the intermediate transfer belt to form a second part of the second pattern;

providing a pattern of cyan toner on the photosensitive drum;

transferring the cyan toner from the photosensitive drum to the intermediate transfer belt to form a third part of the second pattern;

providing a pattern of yellow toner on the photosensitive drum;

transferring the yellow toner from the photosensitive drum to the intermediate transfer belt to form a fourth part of the second pattern, the second pattern of black, magenta, cyan and yellow toners including four spaced differently colored lines corresponding to a black line, magenta line, cyan line and yellow line;

after forming the four parts of the second pattern and without transferring the toner from the intermediate transfer belt to a substrate processed by the image forming device, transferring the toner from the intermediate transfer belt back to the photosensitive drum; and measuring at least one property of the second pattern, to determine if the property is within a desired range, after the toner is transferred back to the photosensitive drum, the measuring comprising measuring a spacing between at least two of the lines.

17. A method of detecting inaccuracies in toner placement on an intermediate transfer belt of an image forming device, comprising:

providing a pattern of black toner on a photosensitive drum of an image forming device;

transferring the black toner from the photosensitive drum to an intermediate transfer belt of the image forming device to form a first part of a second pattern;

providing a pattern of magenta toner on the photosensitive drum;

transferring the magenta toner from the photosensitive drum to the intermediate transfer belt to form a second part of the second pattern;

providing a pattern of cyan toner on the photosensitive drum;

transferring the cyan toner from the photosensitive drum to the intermediate transfer belt to form a third part of the second pattern;

providing a pattern of yellow toner on the photosensitive drum;

transferring the yellow toner from the photosensitive drum to the intermediate transfer belt to form a fourth part of the second pattern; the second pattern of black, magenta, cyan and yellow toners comprising four spaced differently colored lines corresponding to a black line, magenta line, cyan line and yellow line;

after forming the four parts of the second pattern and without transferring the toner from the intermediate transfer belt to a substrate processed by the image forming device, transferring the toner from the intermediate transfer belt back to the photosensitive drum; and measuring at least one property of the second pattern to determine if the Property is within a desired range after the toner is transferred back to the photosensitive drum, the measuring comprising measuring a property of the yellow line.

* * * * *